US006367755B1

(12) United States Patent
Arena

(10) Patent No.: US 6,367,755 B1
(45) Date of Patent: Apr. 9, 2002

(54) INVERTED SUSPENSION FIXTURE

(76) Inventor: Susan Arena, R.R. 3, Box 1043-15, Bridgton, ME (US) 04009

( * ) Notice: Subject to any disclaimer, the term of this patent is extended or adjusted under 35 U.S.C. 154(b) by 0 days.

(21) Appl. No.: 09/520,914

(22) Filed: Mar. 8, 2000

Related U.S. Application Data

(60) Provisional application No. 60/123,384, filed on Mar. 8, 1999, and provisional application No. 60/146,265, filed on Jul. 29, 1999.

(51) Int. Cl.[7] ..... A47H 1/14

(52) U.S. Cl. ..... 248/251; 248/261; 248/262; 248/264; 248/265

(58) Field of Search ..... 248/200, 251, 248/261, 262, 264, 265, 266, 267, 268, 269; 211/105.3

(56) References Cited

U.S. PATENT DOCUMENTS

| | | | | | |
|---|---|---|---|---|---|
| 476,446 | A | * | 6/1892 | Brothwell | 248/265 |
| 564,630 | A | * | 7/1896 | Matthews | 248/261 |
| 871,435 | A | * | 11/1907 | Palmer | 248/265 |
| 937,457 | A | * | 10/1909 | Moffat | 248/263 |
| 1,029,871 | A | * | 6/1912 | Joseph | 160/92 |
| 1,398,411 | A | * | 11/1921 | Akers | 211/96 |
| 1,509,098 | A | * | 9/1924 | Callender | 160/92 |
| 1,565,734 | A | | 12/1925 | Greenhut | 248/265 |
| 1,819,965 | A | * | 8/1931 | Norling | 160/92 |
| 2,254,019 | A | | 8/1941 | Powell | 248/277.4 |
| 2,602,499 | A | * | 7/1952 | Ault | 160/19 |
| 3,095,033 | A | * | 6/1963 | Polkosnik | 160/345 |
| 3,135,489 | A | | 6/1964 | Gledhill | 248/223.41 |
| 4,363,459 | A | | 12/1982 | Holzer | 248/265 |
| 4,824,062 | A | | 4/1989 | Wagner | 248/265 |
| 5,039,049 | A | | 8/1991 | Niemi | 248/265 |

* cited by examiner

*Primary Examiner*—Ramon O. Ramirez
*Assistant Examiner*—Holly N. Sy
(74) *Attorney, Agent, or Firm*—Hovey Williams LLP

(57) ABSTRACT

An inverted suspension fixture (10) for mounting of a valance or curtain across a doorway (12) is provided. The fixture (10) includes first and second brackets (34,32) respectively mounted to the door adjacent the free margin (24) thereof and to the opposed stile (16) or to the portion of the wall (14) adjacent the latter. An elongated, telescoping rod (36) is operatively coupled with the brackets (32, 34) so that, upon opening of the door (20) the rod telescopes together to assume a retracted condition; upon closing of the door (20), the rod telescopes apart to assume its original expanded condition. The fixture (10) may be modified using any combination of brackets **(32, 32*a*, 32*c*, 34)** for double french or atrium doors.

20 Claims, 3 Drawing Sheets

INVERTED SUSPENSION FIXTURE

RELATED APPLICATION

This application claims the benefit of provisional application Ser. No. 60/123,384 filed Mar. 8, 1999 and provisional application Ser. No. 60/146,265, filed Jul. 29, 1999.

BACKGROUND OF THE INVENTION

1. Field of the Invention

The present invention is broadly concerned with suspension fixture assemblies allowing attachment of a valance or curtain across a doorway, to thus obtain a consistent decorative look along the length of a wall. More particularly, the invention pertains to such a fixture and method wherein individual brackets are respectively mounted across the doorway with a telescoping rod supported by the brackets. During opening and closing of the door, the rod telescopes together and apart to accommodate door movement.

2. Description of the Prior Art

Interior designers commonly provide valance or curtain treatment for windows and doors with windows. Such treatments include a stationary rod supporting a depending decorative fabric which covers the upper part of the window and the associated hardware. In many rooms with multiple windows, some of the windows may be a part of the doors and there is a desire that such doorways also have similar or identical valance or curtain treatment. This is commonly done by mounting a stationary valance or curtain across the doorway between the opposed side margins of the door. However, this inevitably leaves an unsightly gap or open region between the window and door treatments. This of course detracts from a desirable consistent style or look. These problems are exacerbated when mounting valances across doors which are recessed with respect to adjacent windows or walls or when the plane of a wall incorporates both recessed and flush doors.

The prior art includes a number of different curtain and valance rod designs.

See, e.g., U.S. Pat. Nos. 1,565,734,2,254,019,3,135,489, 4,363,459,4,824,062 and 5,039,049, as well as Belgian Patent No. 502,830. However, none of these fixture or valance designs address the problem of providing a valance or window treatment completely across a doorway to achieve design consistency, while at the same time permitting uninhibited operation of the door.

SUMMARY OF THE INVENTION

The present invention overcomes the problems outlined above, and provides a suspension fixture assembly for a doorway so that a curtain or valance treatment can be applied across the doorway. Typically, the doorway is provided in an opening in a upright wall, the doorway having a door frame including opposed, upright stiles and a hingedly mounted door within the frame. The door presents an upright hinged side margin hingedly connected to one of the stiles, and an opposed upright free side margin. The overall fixture of the invention broadly includes a first bracket for securement to the door (preferably adjacent the free margin thereof) and having a first operator element. A second bracket is also provided for securement to hinged stile or the wall proximal thereto and has a second operator element. An elongated rod having a pair of telescopically interfitted sections spans the first and second operator elements and is operatively connected thereto so that upon opening of the door, the rod sections will telescope together to assume a retracted condition. Upon closure of the door, the sections will again telescope apart to assume an expanded condition. The rod is configured to receive thereover a shirrable decorative material which is designed to accommodate telescoping movement of the rod during door movement.

In preferred forms, the brackets carry vertical pivot pins which are received within corresponding openings in the rod sections. Thus, upon door movement, the rod pivots relative to the pins and also telescopes together or apart.

Specially configured brackets are provided for double valance assemblies and for french or atrium doors.

DETAILED DESCRIPTION OF THE PREFERRED EMBODIMENT

Figure 1:
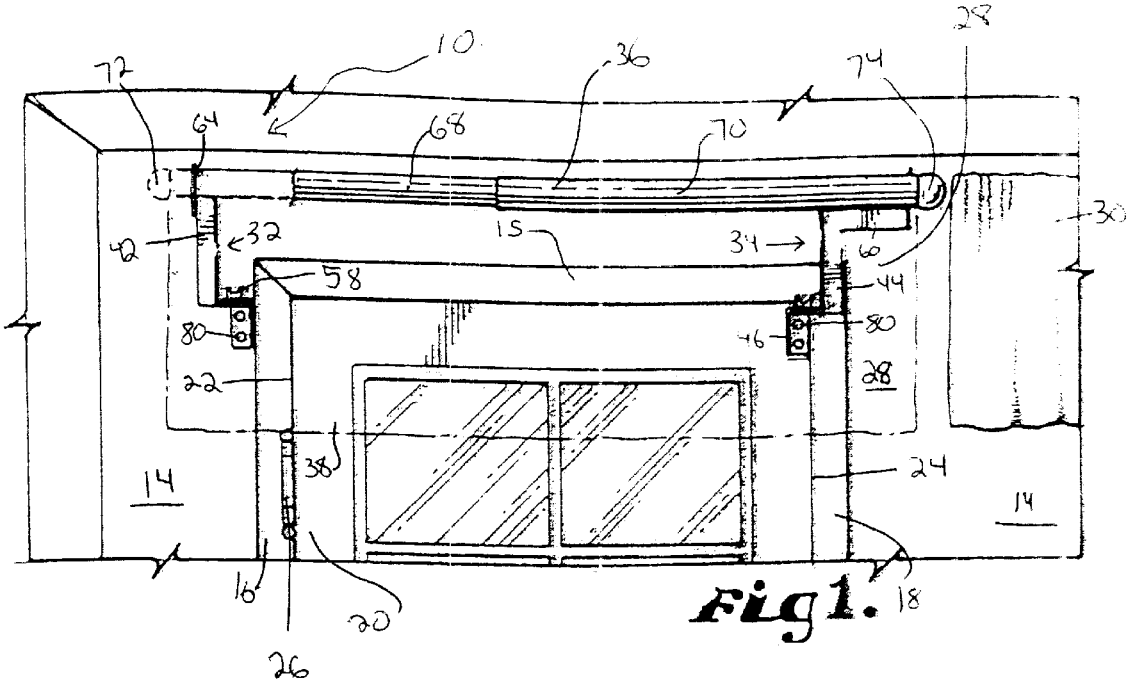
FIG. 1 is a fragmentary front view of a door valance assembly using the inverted suspension fixture of the invention, with a portion of the curtain material being depicted in phantom to reveal the underlying structure of the suspension fixture.
Figure 2:
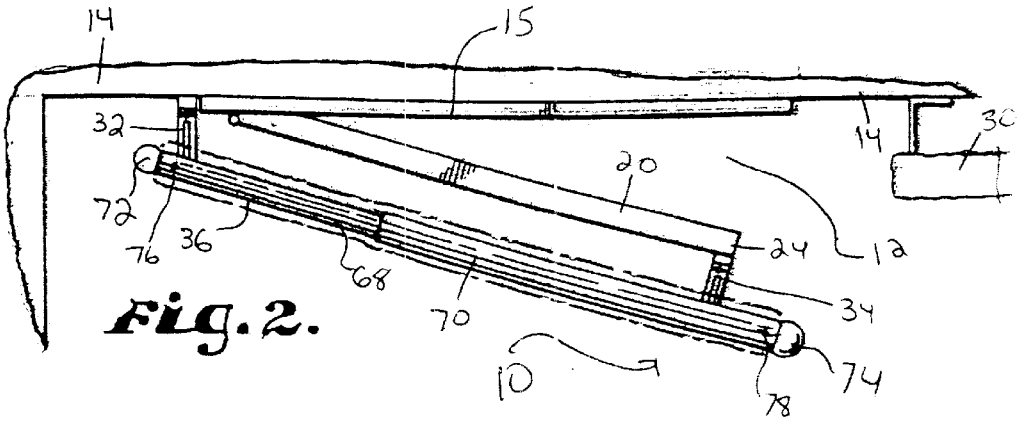
FIG. 2 is a top view of the valance assembly illustrated in FIG. 1, depicting the operation of the suspension fixture during opening of the door.

Turning now to the drawings, and particularly FIGS. 1–2, an inverted suspension fixture 10 in accordance with the invention is illustrated mounted over a doorway 12. The doorway 12 is provided in an upright wall 14 and has a conventional door frame including upright, spaced apart, opposed stiles 16 and 18. A door 20 is mounted within doorway 12 and has an upright hinged side margin 22 and a free side margin 24. As will be readily appreciated, the door 20 is supported by hinges 26 to stile 16, and is openable and closeable in the usual fashion.

The purpose of fixture 10 is to provide a way of supporting a decorative valance or curtain 28 across the doorway 12 so as to maintain a desired consistent appearance along the wall 14. As illustrated in FIG. 1, the wall portion to the right of doorway 12 has a conventional valance 30. Through use of the present invention, the entire doorway 12 can also have a similar valance so that a consistent look and a minimum gap between the valances is achieved. At the same time, the normal opening and closing of the door 20 is not affected.

The fixture 10 broadly includes a pair of brackets 32, 34 as well as a telescoping rod 36. The rod 36 is adapted to receive thereover and support a shirrable length of fabric 38 similar or identical to the fabric making up valance 30.

Figure 4:
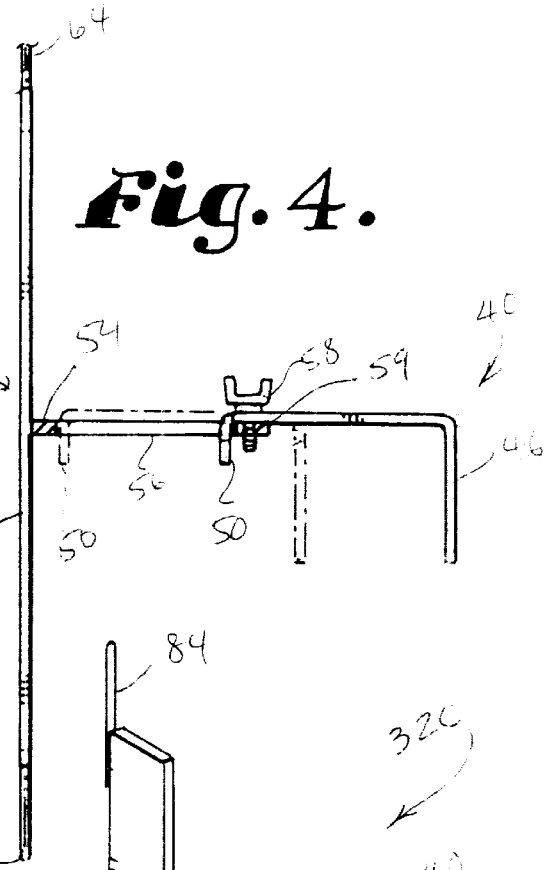
FIG. 4 is a side elevational view of the bracket depicted in FIG. 3, with the adjustable nature of the standoff leg of the bracket illustrated in phantom.
Figure 5:
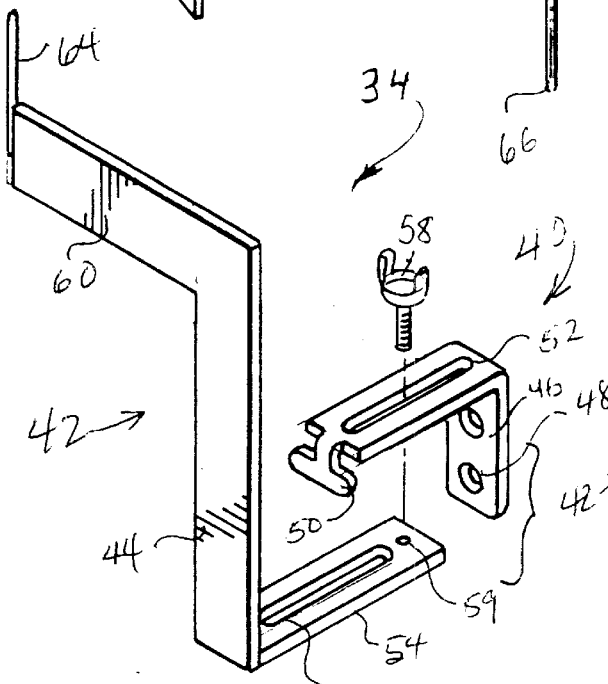
FIG. 5 is a perspective view similar to that of FIG. 3 but illustrating a different bracket having only a single rod-supporting pivot pin.
Figure 7:
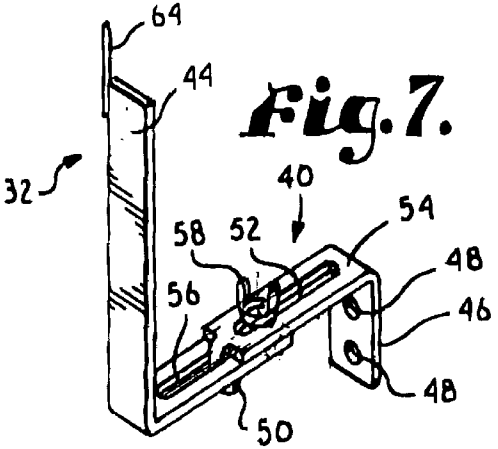
FIG. 7 is a perspective view of another embodiment of a bracket of the invention, used in areas with limited clearance.

Attention is next directed to FIGS. 5 and 7, illustrating in detail the brackets 34 and 32, respectively. In this connection, it will be appreciated that bracket 34 in FIG. 1 and bracket 34 in FIG. 5 are identical, and are merely mirror images relative to each other. In more detail, the bracket 32 broadly includes standoff leg 40, and a rod-supporting leg 42, the latter having an offset portion 44. The standoff leg 40 preferably is adjustable and to this end includes an L-shaped connector 46, with one leg thereof provided with fastener-receiving openings 48, while the other leg is equipped with an endmost, T-shaped, down-turned coupler 50 and an elongated slot 52. In addition, the rod supporting leg includes a plate 54 rigidly secured to the leg 42. The plate 54 has a slot 56 therein designed to register with the slot 52. Similar to the exploded view of bracket 34 shown in FIG. 5, go the connector 46 secures to the plate 54 by means of a winged screw 58 passing through the slot 52 and into a threaded bore 59, provided in the plate 54, with the coupler 50 interlocking with the slot 52. As depicted in FIG. 4, this arrangement allows the standoff leg 40 to be adjustable, so as to permit selective adjustment of the distance between the doorway 12 and the rod 36.

The rod-supporting leg 42 is of a somewhat offset vertical configuration, presenting the elongated offset portion 44 as well as a generally vertically extending operating element in the form of an extending pivot pin 64.

Bracket 34, illustrated in detail in FIG. 5, broadly includes standoff leg 40 and a rod-supporting leg 42. Rod-supporting leg 42 presents laterally extending upper segment 60 and includes a vertically extending operating element in the form of pivot pin 64 extending from upper segment 60. The standoff leg 40 preferably is adjustable and to this end includes an L-shaped connector 46, with one leg thereof provided with fastener-receiving openings 48, while the other leg is equipped with an endmost, T-shaped, down-turned coupler 50 and an elongated slot 52. In addition, the standoff leg includes a plate 54 rigidly secured to the leg 42. The plate 54 has a slot 56 therein designed to register with the slot 52. Similar to the exploded view illustrated in FIG. 5, the connector 46 is secured to the plate 54 by means of a winged screw 58 passing through the slot 52 and into a threaded bore 59 (not shown in FIG. 7), provided in the plate 54, with the coupler 50 interlocking with the slot 52. Once again, this arrangement allows the standoff leg 40 to be adjustable, so as to permit selective adjustment of the distance between the doorway 12 and the rod 36.

The rod 36 is an essentially conventional valance or curtain rod and includes first and second telescopically interfitted tubular sections 68, 70 with optional decorative end pieces 72, 74 depicted in FIGS. 1–2. The rod sections 68, 70 have bores 76, 78 therethrough (see FIG. 2) which are respectively adjacent the ends of the sections. In some conventional rods, bores 76, 78 will be pre-drilled while in others, such as typical round telescoping rods, bores 76, 78 will need to be drilled into the rod 36 at appropriate locations.

Again referring to FIG. 1, it will be observed that bracket 32 is affixed by screw fasteners 80 to the wall 14 adjacent the upper end thereof preferably close to hinged margin 22 thereof. In this case, it will be observed that the upper pin 64 is positioned just to the left of stile 16, but could be attached further to the left if so desired. Alternately, bracket 32 could be attached to the stile 16 proximal to the wall 14. Similarly, bracket 34 is affixed by screw fasteners 80 to the door 20 such that segment 60 extends rightwardly from the door connection so that the pin 64 is spaced laterally from the stile 18. The bracket 34 as mentioned is merely an mirror image the bracket 34 depicted in FIG. 5.

In use, the brackets 32, 34 are installed as indicated, and the shirrable fabric 38 is slid over the telescoping rod 36. At this point, the rod 36 is installed on the brackets by insertion of the upper pins 64 into the rod bores 76, 78. The overall assembly thus assumes configuration of FIG. 1 wherein the valance extends from a point to the left of stile 16 across the entire width of the door 20 and in covering relationship to at least a portion of the stile 18. This achieves the goal of providing uniform style and look along the entire wall 14.

When it is desired to open the door 20 (see FIG. 2), the rod 36 pivots about the pins 64 and also telescopes together to assume a retracted condition. During this sequence, the fabric 38 is progressively bunched or shirred to accommodate such rod movement. This continues until the door is fully opened, i.e., it assumes a condition up to 90° or more relative to the door frame 15. Of course, when the door 20 is closed, this operation is reversed until the valance assembly again assumes its extended FIG. 1 condition.

Figure 3:
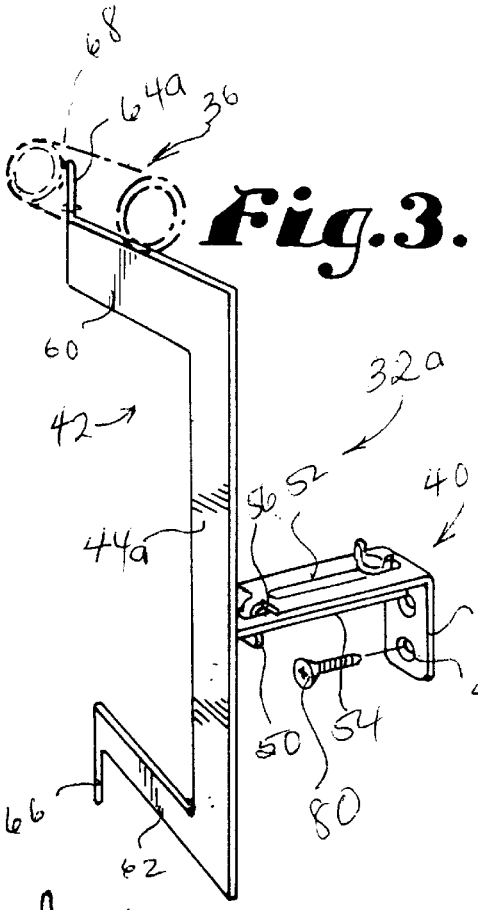
FIG. 3 is a perspective view of one of the suspension fixture brackets, and illustrating in phantom pivotal connection of a valance rod thereto.
Figure 8:
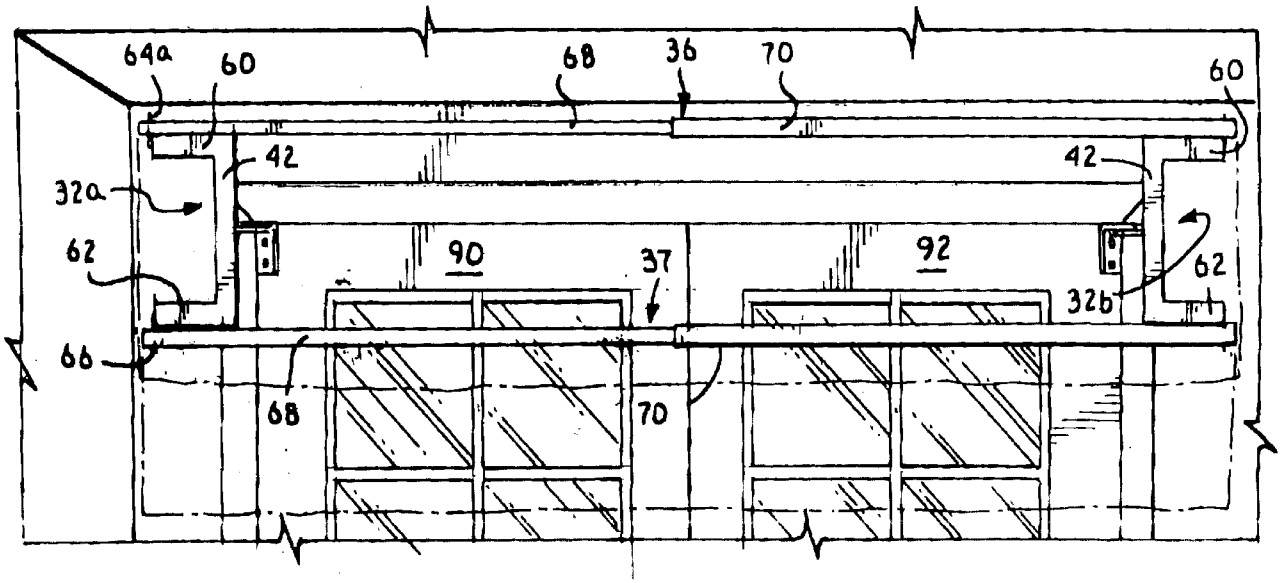
FIG. 8 is a fragmentary front view of an atrium door valance assembly using the inverted suspension fixture of the invention, with a portion of the curtain material being depicted in phantom to reveal the underlying structure of the suspension fixture.

FIGS. 3 and 8 illustrate another preferred embodiment in accordance with the present invention that is particularly well suited for double rod application to atrium-style doors as shown in FIG. 8. Brackets 32a and 32b are mirror images of one another and broadly include standoff leg 40, and a rod-supporting leg 42, the latter having a C-shaped offset portion 44*a* presenting laterally extending segments 60, 62 at each end thereof. The standoff leg 40 preferably is adjustable and to this end includes an L-shaped connector 46, with one leg thereof provided with fastener-receiving openings 48, while the other leg is equipped with an endmost, T-shaped, down-turned coupler 50 and an elongated slot 52. In addition, the standoff leg includes a plate 54 rigidly secured to the leg 42. The plate 54 has a slot 56 therein designed to register with the slot 52. As shown in the exploded view, the connector 46 secures to the plate 54 by means of a winged screw 58 passing through the slot 52 and into a threaded bore 59, provided in the plate 54, with the coupler 50 interlocking with the slot 52. Laterally extending segments 60, 62 include upper and lower rod mounting pins 64*a*, 66, and thereby permit attachment of upper 36 and lower 37 valance rods thereto. In order to attach lower rod 37 to the downwardly extending pins 66, sufficient shirred material is provided between the pins on the rod to effect a frictional lock, i.e., the bunched or shirred fabric exerts a sufficient lateral force to cause the rod to frictionally engage the pins and thus prevent the rod from falling off the pins. Typically, a single valance is provided which covers brackets 32*a* and 32*b* including laterally extending segments 60, 62. In this manner, the valance acts as a sleeve, thereby holding rod 37 in place on pins 66. Rod 37 may also be held in place by a separate elastic sleeve extending along the length of rod 37 between laterally extending segments 62 of brackets 32*a* and 32*b*. This configuration would permit separate valances to be hung from each of rods 36 and 37. Alternatively, pins 66 could receive a cap (not shown) thereon to prevent disengagement of rod 37. In an atrium-style doorway application, bracket 32*a* is affixed to stationary (i.e. non-opening) door 90 while bracket 32*b* is affixed to functional door 92. Thus, bracket 32*a* functions as if attached to a wall or stile.

Figure 6:
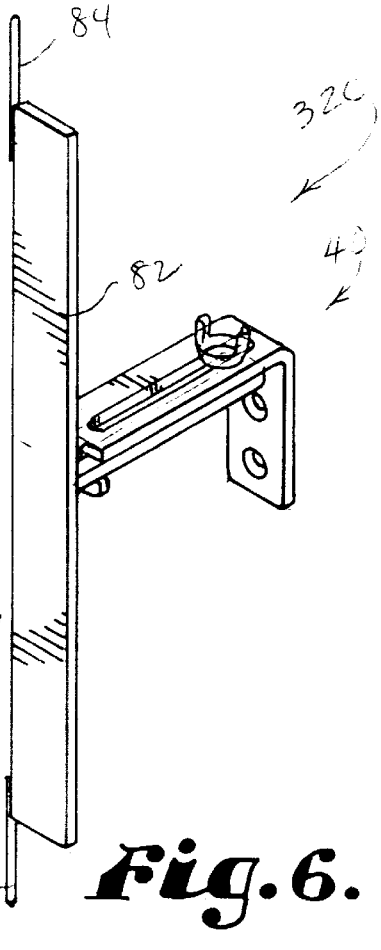
FIG. 6 is a perspective view of another embodiment of a bracket of the invention, used in connection with double french doors or in areas with limited clearance.

A still further bracket 32*c* in accordance with the invention is illustrated in FIG. 6. In this case, the bracket 32*c* is designed for use on french or atrium doors or in areas having limited clearance. The bracket 32*c* has the identical standoff leg 40 described previously, whereas the leg 42 is in the form of a straight, vertically extending plate 82 having opposite projecting upper and lower pins 84, 86. The bracket 32*c* is especially designed for mounting adjacent the free margins of adjacent french doors or adjacent corners between two walls so as to permit opening thereof without interference. Additionally, this bracket may be employed where space is limited and there is not enough room provided to accommodate a C-shaped bracket such as those shown in FIGS. 3, 5 and 8. In all other respects, the use of the bracket 32*c* is identical to that described above.

As can be appreciated, thc brackets depicted and described herein are interchangeable in order to suit any window and door layout combination as well as to accommodate for any clearance problems arising from adjacent doors or walls. For example, if atrium doors are located too close to an adjacent wall to accommodate a C-shaped bracket (such as the one illustrated in FIG. 3), the bracket of FIG. 6 could be used in a double rod application or the bracket illustrated in FIG. 7 could be used in a single rod application. Additionally, while the mounting depth of brackets in accordance with the present invention is preferably adjustable, non-adjustable, stationary mounting brackets could be employed. Common sizes used with such brackets include 1 inch or 1½ inch flush brackets. Preferably, such brackets would be provided with access holes on the face of the brackets in order to provide access to the screws used to mount the brackets to the corresponding door or wall. Furthermore, rods 36, in accordance with the present invention embrace conventional round and flat telescoping rods as both can be utilized as desired.

It will thus be seen that the invention provides suspension fixtures enabling a designer to obtain different valance or curtain appearance across a doorway nevertheless permitting normal opening and closing of the door.

I claim:

1. An inverted suspension fixture for a doorway provided in an opening in an upright wall, the doorway having a door fame including two opposed, upright stiles, and a hingedly mounted, openable and closable door within the door frame, the door presenting an upright hinged side margin adjacent one of the stiles and hingedly connected thereto, and an opposed upright free side margin, said fixture comprising:

a first bracket adapted for securement to the door having a first operator element;

a second bracket adapted for securement to one of the stiles or the wall proximal thereto and having a second operator element, said first operator element and said second operator element each being pivot pins supported by said fist bracket and said second brackets respectively, a first elongated rod having a pair of telescopically intermitted sections, said pivot pins received within a corresponding opening in each of said sections; and at least one of said first bracket and said second bracket including an assembly, said assembly presenting a first end proximal to a rod-supporting leg and a second end distal to said rod-supporting leg, and being operable for selectively adjusting the distance between said assembly first end and said assembly second end; and said first rod spanning said first operator element and said second operator element and operatively connected thereto so that upon opening of the door said sections telescope together to assume a retracted position, and upon closing of the door said sections will telescope apart to assume an expanded condition.

2. The fixture of claim 1 said first rod configured to receive thereover a length of shirrable decorative material.

3. The fixture of claim 1, said assembly including a standoff leg and said rod-supporting leg with a respective said first operator element or said second operator element thereon, said stand off leg being adjustable to permit relative lateral movement between said standoff leg and said rod-supporting leg.

4. The fixture of claim 3, said rod-supporting leg including an offset portion from said standoff leg, whereby said first operator element and said second operator element are spaced vertically from the respective standoff leg.

5. The fixture of claim 1, each of said first bracket and said second bracket having a pair of said first operator elements and said second operator elements respectively, there being a second rod having a pair of telescopically interfitted sections and operatively connected to one of said first operator elements and one of said pair of said pair of said second operator elements so that said first rod and said second rod are vertically spaced and generally parallel to each other.

6. The fixture of claim 1, said first rod having in the expanded condition thereof a length greater than the width of the doorway between the upright hinged side margin and the opposed upright free side margin thereof.

7. The fixture of claim 4, each of said first bracket and said second bracket having threaded fasteners for securement thereof.

8. In combination:

a doorway provided in an opening in an upright wall, said doorway having a door frame including two opposed, upright stiles;

a hingedly mounted, openable and closable door within said door frame, said door presenting an upright hinged side margin adjacent one of said stiles and hingedly connected thereto, and an opposed upright free side margin;

an inverted suspension fixture for said doorway, said fixture comprising:

a first bracket for securement to said door having a first operator element;

a second bracket for securement to said one of said stiles or the wall proximal thereto and having a second operator element, said first operator element and said second operator element each being pivot pins supported by said first bracket and said second brackets respectively;

an elongated rod having a pair of telescopically interfitted sections, said pivot pins received within a corresponding opening in each of said sections; and at least one of said first bracket and said second bracket including an assembly, said assembly presenting a first end proximal to a rod-supporting leg and a second end distal to said rod-supporting leg, said assembly being operable for selectively adjusting the distance between said assembly first end and said assembly second end; and said rod spanning said first operator element and said second operator element and operatively connected thereto so that upon opening of said door the sections telescope to assume a retracted position, and upon closing of the door the sections will telescope to assume an expanded condition.

9. The combination of claim 8, said rod configured to receive thereover a length of shirrable decorative material.

10. The combination of claim 8, said assembly including a standoff leg and said rod-supporting leg with a respective said first operator element and said second operator element thereon, said standoff leg being adjustable to permit relative lateral movement between said standoff leg and said rod-supporting leg.

11. The combination of claim 10, each of said first bracket and said second bracket also including an offset leg between said standoff leg and said rod-supporting leg, whereby said first operator element and said second operator element are spaced from the respective standoff leg.

12. The combination of claim 11, each of said first bracket and said second bracket also including an offset portion between said standoff leg and said rod-supporting leg, whereby said first operator element and said second operator element are spaced vertically from the respective standoff leg.

13. The combination of claim 8, said rod having in the expanded condition thereof a length greater than the width of the door between said upright hinged side margin and said opposed upright free side margin thereof.

14. The combination of claim 8, each of said first bracket and said second bracket having threaded fasteners for securement thereof.

15. A method of covering a doorway with a valance, said doorway provided in an opening in an upright wall, said doorway having a door frame including two opposed, upright stiles, and a hingedly mounted, openable and closable door within said door frame, said door presenting an upright hinged side margin adjacent one of said stiles and hingedly connected thereto, and an opposed upright free side margin, said method comprising the steps of:

providing an inverted suspension fixture for said doorway, said fixture comprising:

a first bracket for securement to said door having a first operator element;

a second bracket for securement to said one of said stiles or the wall proximal thereto and having a second operator element, said first operator element and said second operator element each being pivot pins supported by said first bracket and said second brackets respectively;

at least one of said first bracket and said second bracket including an assembly, said assembly presenting a first end proximal to a rod-supporting leg and a second end distal to said rod-supporting leg, said assembly being operable for selectively adjusting the distance between said assembly first end and said assembly second end; and providing a telescoping rod having an extended length and a retracted length, said extended length being greater than the width of said door between said upright hinged side margin and said opposed upright free side margin thereof;

securing said rod between said first operator element and said second operator element in spanning relationship across said door; and when said door is open, causing said rod to telescope to assume said retracted length, and causing the rod to telescope back to said extended length when said door is closed.

16. The method of claim 15, securing said rod includes pivotally coupling said rod to said door and to one of said stiles or to the wall proximal to one of said stiles.

17. An inverted suspension fixture for a doorway provided in an opening in an upright wall, said doorway having a door frame including two opposed, upright stiles, and a hingedly mounted, openable and closable door within said door frame, said door presenting an upright hinged side margin adjacent one of said stiles and hingedly connected thereto, and an opposed upright free side margin, said fixture comprising:

a first bracket for securement to said door;

a second bracket for securement to one of said stiles or the wall proximal thereto;

a first elongated rod having a pair of telescopically interfitted sections;

each of said first bracket and said second bracket having a pair of said first operator elements and said second operator elements respectively, there being a second rod operatively connected to one of said pair of said first operator elements and one of said pair of said second operator elements so that said first rod and said second rod are vertically spaced and generally parallel to each other; and said first rod spanning said first operator element and said second operator element and operatively connected thereto so that upon opening of said door the sections telescope together to assume a retracted position, and upon closing of the door the sections will telescope apart to assume an expanded condition.

18. A bracket for attachment adjacent a doorway having a frame, said bracket adapted to hold a rod containing a length of shirrable material thereon, said bracket comprising:

a standoff leg presenting a first end adapted for attachment to the door frame and an opposed second end extending therefrom;

a rod-supporting leg attached to said second end and extending vertically therefrom, said rod-supporting leg presenting at least one laterally extending segment; and an operator element attached to said laterally extending segment, said operator element adapted for pivotal attachment to the rod.

19. The bracket of claim 18, including two laterally extending segments.

20. The bracket of claim 18, said laterally extending segment being oriented in a covering relationship to the door frame.

* * * * *